US006503329B2

(12) United States Patent
Patton et al.

(10) Patent No.: US 6,503,329 B2
(45) Date of Patent: Jan. 7, 2003

(54) MODIFICATION OF RECEIVER SURFACE TO REJECT STAMP CANCELLATION INFORMATION

(75) Inventors: David L. Patton, Webster, NY (US); Frank Pincelli, Rochester, NY (US); H. Mark Delman, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/931,441

(22) Filed: Aug. 16, 2001

(65) Prior Publication Data

US 2002/0017782 A1 Feb. 14, 2002

Related U.S. Application Data

(62) Division of application No. 09/605,246, filed on Jun. 28, 2000.

(51) Int. Cl.[7] ..... B05C 5/02

(52) U.S. Cl. ..... 118/669; 118/46; 283/71; 347/2; 101/371

(58) Field of Search ..... 118/45, 46, 669; 427/154–156; 283/71; 347/99, 2, 19; 428/41.7, 42.1, 348, 354; 101/371

(56) References Cited

U.S. PATENT DOCUMENTS

| | | | | | |
|---|---|---|---|---|---|
| 3,869,986 | A | * | 3/1975 | Hubbard | 101/91 |
| 4,580,144 | A | * | 4/1986 | Calvi | 101/109 |
| 4,846,502 | A | * | 7/1989 | Chang et al. | 283/57 |
| 5,332,713 | A | | 7/1994 | Oldfield et al. | |
| 5,373,115 | A | * | 12/1994 | Manduley et al. | 177/50 |
| 5,387,573 | A | | 2/1995 | Oldfield et al. | |
| 5,423,573 | A | | 6/1995 | de Passillé | |
| 5,873,605 | A | | 2/1999 | Kaplan | |
| 5,984,539 | A | | 11/1999 | Patton et al. | |
| 6,054,170 | A | * | 4/2000 | Chess et al. | 427/288 |
| 6,112,193 | A | * | 8/2000 | Dlugos et al. | 283/71 |

FOREIGN PATENT DOCUMENTS

| | | |
|---|---|---|
| GB | 1474203 | 5/1977 |
| JP | 2000-112356 | 4/2000 |
| WO | 99/60551 | 11/1999 |

* cited by examiner

*Primary Examiner*—Laura Edwards
(74) *Attorney, Agent, or Firm*—Frank Pincelli

(57) ABSTRACT

An official postal product, and a method and apparatus for making the official postal product. The official postal product includes a first image area having an official postal indicia a second image area having a personal image. A protective coating is placed over the second image area such that official cancellation mark placed over the second area will not permanently adhere to the personal image.

5 Claims, 8 Drawing Sheets

MODIFICATION OF RECEIVER SURFACE TO REJECT STAMP CANCELLATION INFORMATION

CROSS REFERENCE TO RELATED APPLICATIONS

This is a divisional application of U.S. Ser. No. 09/605,246, filed Jun. 28, 2000.

FIELD OF THE INVENTION

This invention relates to an article and system used for creating a coating on an image produced by a thermal printer, wax sublimation printer, electrophotographic printer or inkjet printer, with a layer of material that produces a surface capable of rejecting information transferred by a stamp canceling device.

BACKGROUND OF THE INVENTION

At present, official postage stamps are designed to accept a cancellation mark as the stamp passes through the postal sorting equipment. The cancellation mark shows the stamp has been used as postage on a piece of mail and cannot be used again. With the advent of the personalized postage stamp as described in U.S. Pat. No. 5,873,605 a consumer can submit a personal image and have the personal image become part of the postage stamp 10 as shown in FIG. 1. The stamp 10 comprises an official postal image (indicia) 20 printed in an official postal image area 24 bordered on the inside border by lines 25, 26, 27, and 28 and on the outside edge by perforations 30. The stamp 10 includes a personal image 40 lying inside the personal image area 45 bordered by the lines 25, 26, 27, and 28. The personalized postage stamp 10 can be created using several methods. Images that can be used for the personal image portion of the personalized postage stamp 10 can be consumer images obtained from a variety of sources. For example, but limited to, consumer image files stored in digital formation floppy disks, Picture CDs, Photo CDs, CD-ROMs, down loaded from the Internet, and negatives and prints scanned using the consumer's own scanner.

Typically because of the high quality required, the official postal image 20 on a postage stamp 10 is printed first using a Gravure process. The Gravure process is capable of creating images of very high resolution, way beyond the capabilities of most common printers. The Gravure process is an intaglio process. It uses a depressed or sunken surface etched into a copper cylinder to create the image and the unetched surface of the cylinder represent non-printing areas. The cylinder rotates in a bath of ink and the etched area picks up the ink and transfers it to the media creating the image. Gravure printing is considered excellent for printing highly detailed marks or pictures and meet all the specifications required for printing an official postage stamp.

Since the personal image 40 is not part of the official postal stamp, meaning the official postal image 20 can be used as postage without the personalized image area 40, while the personalized image 40 cannot. The personal image 40 can be printed at a later time using for example, a thermal printer, wax sublimation printer, electro-photographic printer or ink jet printer directly onto the stamp 10 as shown in FIG. 1. The personal image 40 can be printed as a separate sticker 41 and adhered directly to the official stamp in a designated area 50 as shown in FIG. 2*a* such as is disclosed in U.S. Pat. No. 5,423,573. The personal image 40 can also be printed adjacent to or below the stamp 10 as shown in FIG. 2*b* and FIG. 2*c* respectively such as is disclosed in international patent application PCT/AU99/00346.

There are several problems with the systems and methods disclosed in the prior art. The first is when a postal product such as a stamp 10 with the personal image area 45 is affixed to an envelope 70 and used for postage. However, the postal product may be integrally part of a postcard, label or any other item now used for retaining official postage. The stamp cancellation device prints the cancellation mark 60 across the entire surface of the stamp 10 as shown in FIG. 3. For the purposes of the present invention an official postal product shall be defined as a product by itself or as affixed to another product and that is recognized as official postage, which can be used to send items through the official governmental postal system. The cancellation mark 60 extends across the official postal area 24 of the stamp 10 as well as the personal image area 45 thus obscuring the personalized portion. A typical official United States postage stamp is printed with inks that have a pigment, when excited by ultraviolet light at a peak wavelength of 254 nanometers, phosphoresce in the visible (green) region of the spectrum with a peak wavelength of 526 nanometers. Current equipment in the post office is used for scanning of the postage for verifying that it is authentic postage and to locate where the stamp is on the envelope for cancellation. Because of the nature of the equipment used to print the cancellation mark no attempt is made to place the cancellation mark other than to ensure the mark is printed across a portion of the stamp.

The present invention provides a method and system for customizing an official postal product that solves many of the problems of the prior art. The method and system also provides high quality images on official postal products having the required quality, characteristics, and content standards.

SUMMARY OF THE INVENTION

In one aspect of the present invention there is provided an apparatus for applying a protective coating on a personalized image product, the personalized image product is comprised of a first area having an official postage image thereon and a second area having a personal image thereon.

A scanner capable of determining the location of the second area and a coating device for applying a protective coating only to the second area as determined by said scanner in response to the scanner determining the location of said second area, said protective coating for repelling a postal cancellation mark.

In another aspect of the present invention there is provided an apparatus for providing a cancellation on an official postal product. The official postal product having a first area having an official image area having official postal indicia and a second area having a personal image. The apparatus having a scanner for determining the location of the first area and a printhead for applying a cancellation onto the first area as determined by said scanner in response to the scanner locating said first area.

These and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

Figure 1:
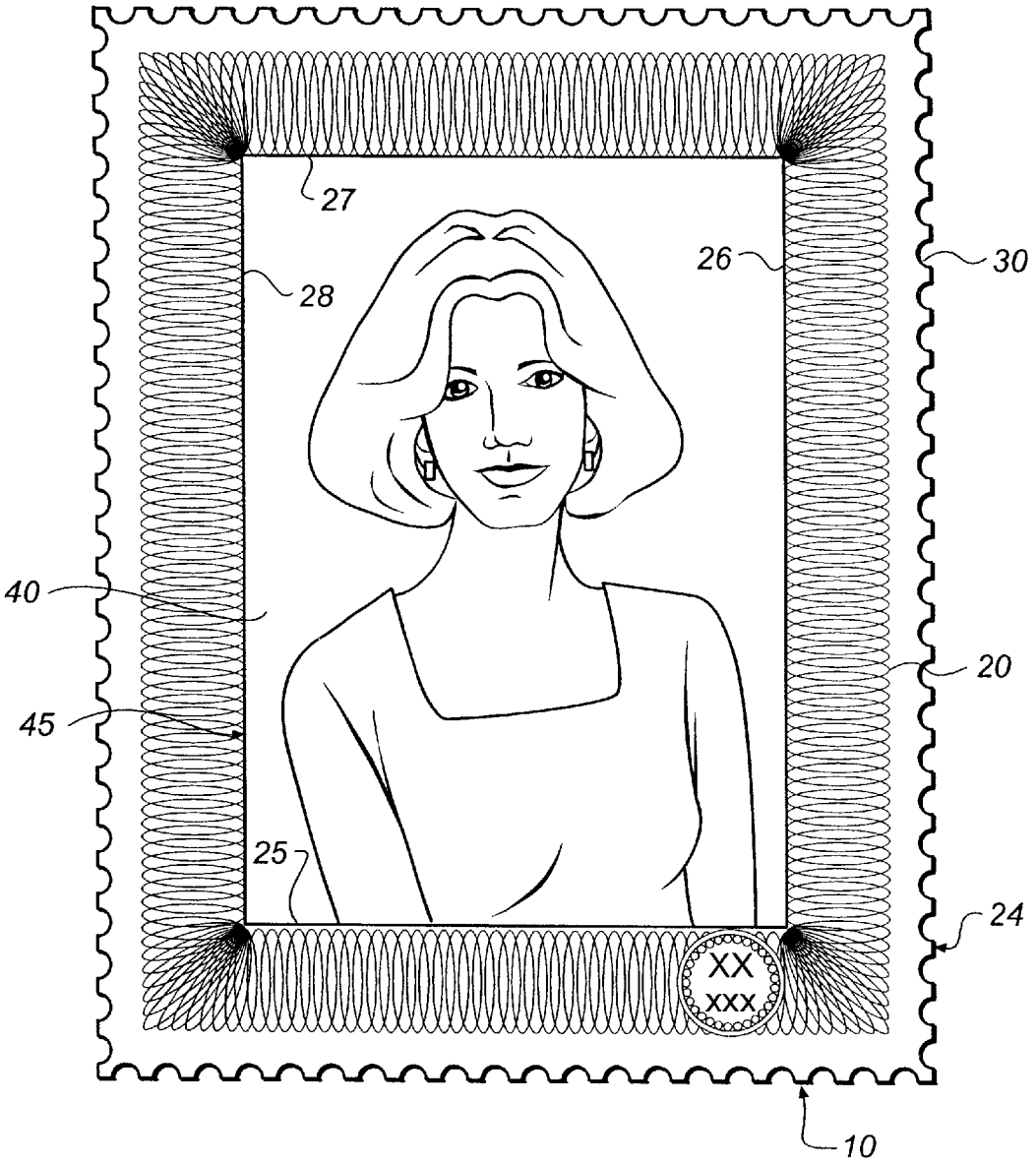
FIG. 1 (PRIOR ART)
FIG. 1 is a plan view of a personalized postage stamp made in accordance with the prior art.
Figure 2C:
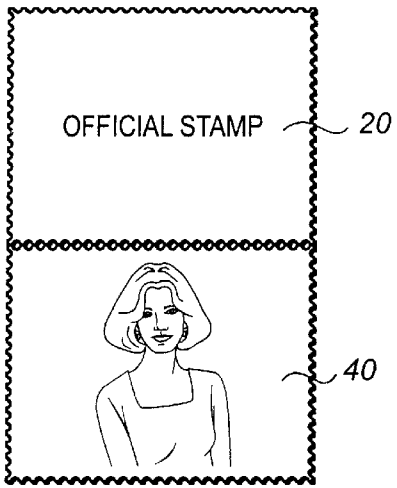
FIG. 2c (PRIOR ART)
FIGS. 2*a*, 2*b*, and 2*c* are plan views of a personalized postage stamp made in accordance with the prior art.
Figure 2B:
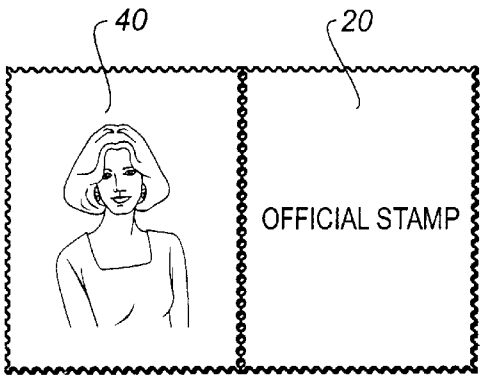
FIG. 2b (PRIOR ART)
Figure 2A:
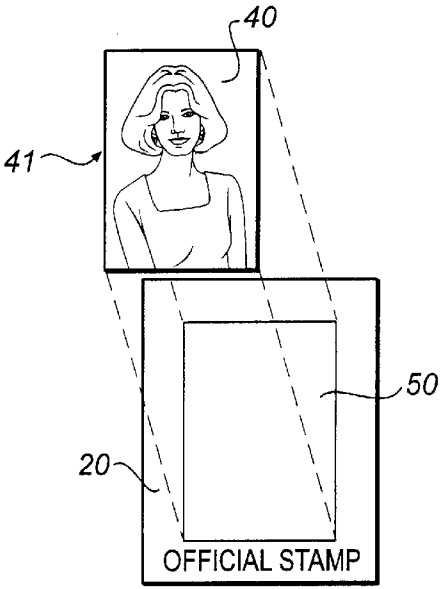
FIG. 2a (PRIOR ART)
Figure 3:
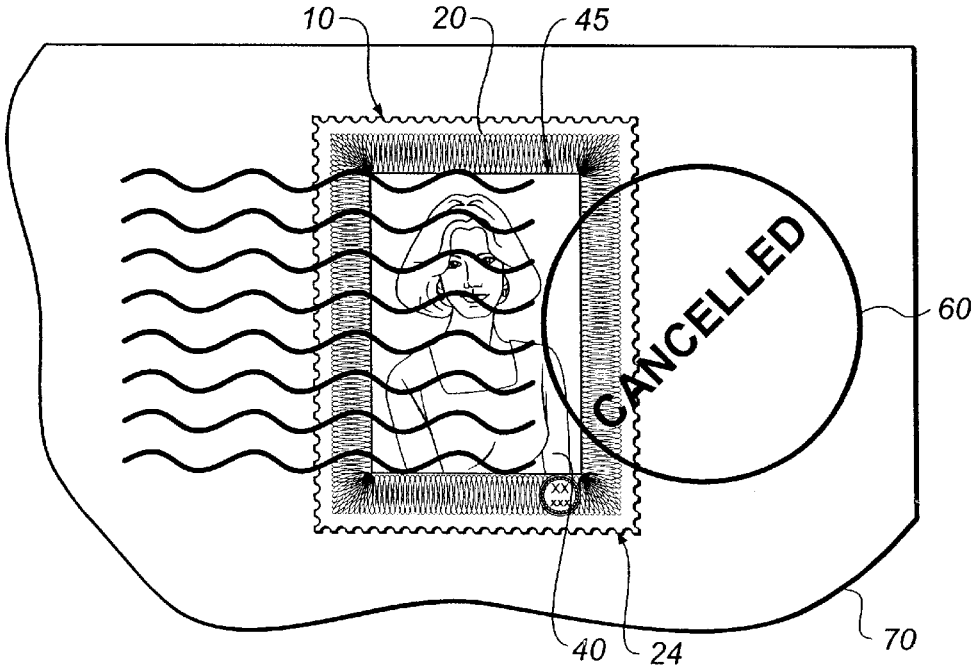
FIG. 3 (PRIOR ART)
FIG. 3 is a plan view of a portion of an envelope with a postal product in the form of a personalized postage stamp affixed to the envelope having a postal cancellation mark in accordance with the prior art.
Figure 4:
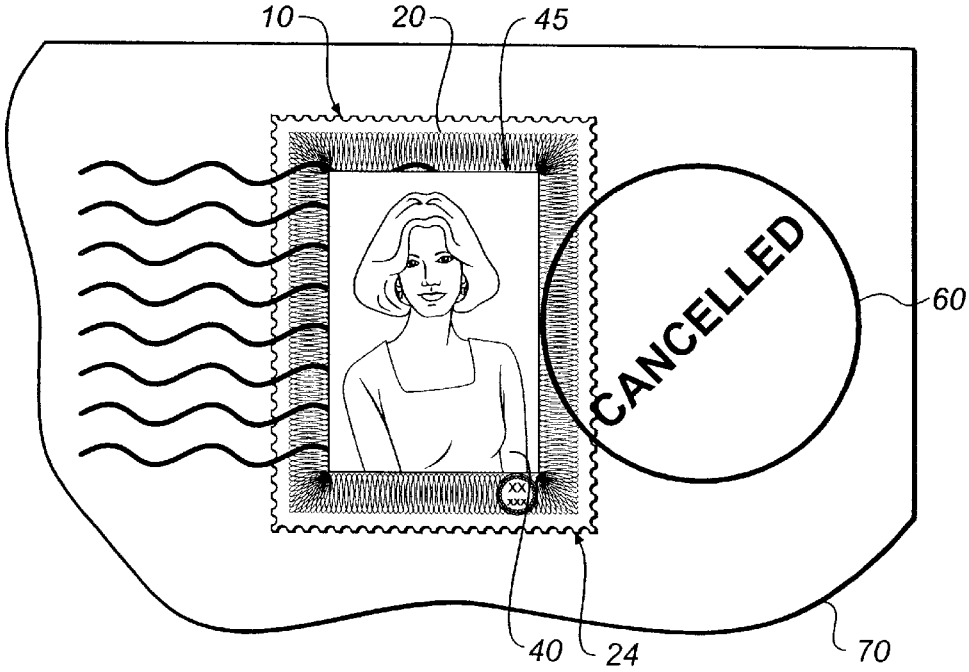
FIG. 4 is a plan view of a portion of an envelope with a postal product in the form of a personalized postage stamp affixed to the envelope having a postal cancellation mark in accordance with the present invention.

Referring to FIG. 4, there is illustrated a plan view of a portion of an envelope 70 having a postal product in the form of a personalized postage stamp 10 attached thereto made in accordance with the present invention. A protective coating 80 (shown in FIG. 7) of a material has been applied to the personal image 40 of the stamp 10. The protective coating repels the cancellation mark 60, which is applied across the entire surface of the stamp 10 during the postage sorting and cancellation process. Because the protective coating 80 is applied only to personal image 40 the cancellation stamp 60 will adhere to the official postal image 20 of the stamp 10.

Figure 5:
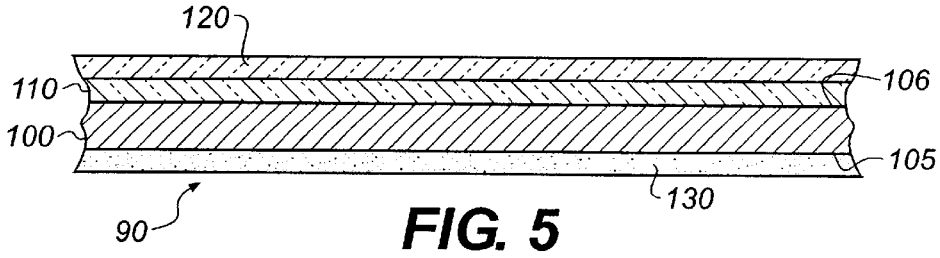
FIG. 5 is a cross-sectional view of a medium having a coating, which can be used with a personalized postage stamp printer made in accordance with the present invention.

Referring to FIG. 5, there is illustrated a cross-sectional view of a medium 90 which can be used with a printer for making a personalized postage stamp in accordance with the present invention. The medium 90 comprises a support layer 100. The support layer 100 can be formed of paper, for example photographic paper without the emulsion or plastic such as polyethylene terephthalate or polyethylene napthhlate on the bottom surface 105 of the support layer 100 is coated an adhesive layer 130. The adhesive is typical of the adhesive layer found on the back of stamps. In one form, the adhesive must be moistened before applying the stamp to the envelope. In a second form, the adhesive is self-adhering such as in the case of a sticker. Over the top surface 106 of the support layer 100 there is provided a translucent or transparent receiving layer 110. The receiving layer 110 is designed to receive an image placed thereon by the printer. In the embodiment illustrated, the translucent or transparent receiving layer 110 comprises gelatin and polymer having a 50:50 mix ratio. The gelatin may be any commercially available gelatin as is well known in the art. The polymer is AQ55, which may be purchased from the Eastman Chemical Corporation. Placed over the translucent receiving layer 110 is a protective translucent or transparent layer 120, which in the particular embodiment illustrated is methylcellulose. The protective layer 120 shields and protects the image 200 (shown in FIG. 6) from abrasion and UV rays but not from moisture. The receiving layer 110 and protective layer 120 may be applied in any well known coating techniques used for applying a thin layer on a substrate.

Figure 6:
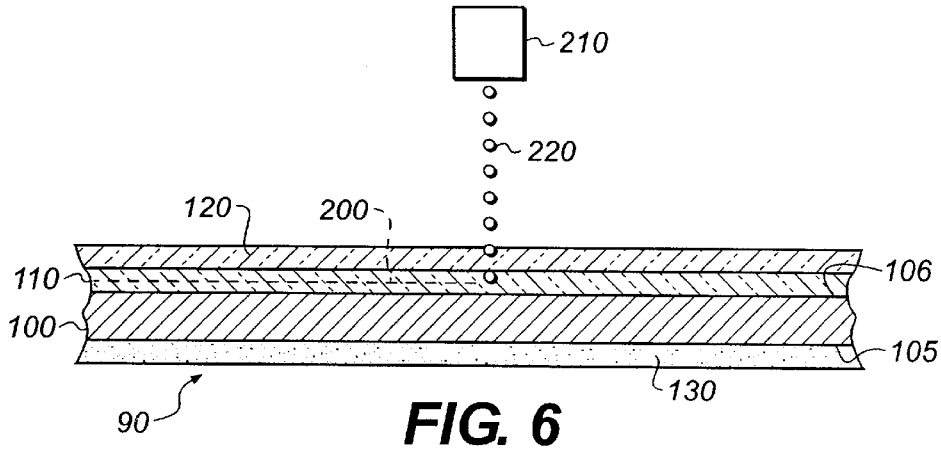
FIG. 6 is a schematic drawing illustrating the application of ink via an inkjet printer onto medium.

Referring to FIG. 6, there is illustrated a schematic view of medium 90 with an image 200 being applied via a digital inkjet printer head 210 found in a typical prior art inkjet printer. For example, head 210 may be of any commercial type found in the following printers: Canon BJC-610, BJC-4100, Hewlett Packard HP682, HP855, HP870, or Epson Stylus 500. The ink 220 may be of as any commercially available ink used by these printers. The ink 220 passes through the protective layer 120 and is absorbed by the receiving layer 110. As is illustrated in FIG. 6, the image 200 is formed in the translucent receiving layer 110. The image 200 may also be formed using and a digital electrophotographic printer such as an Indigo-E-1000.

Figure 7:
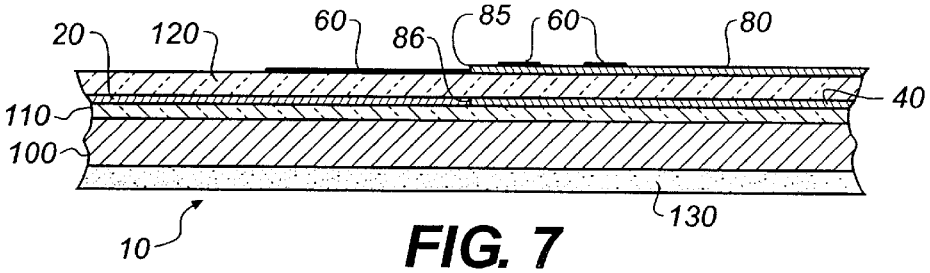
FIG. 7 illustrates a cross-sectional view of the personalized postage stamp formed in the receiving layer made in accordance with the present invention.
Figure 8:
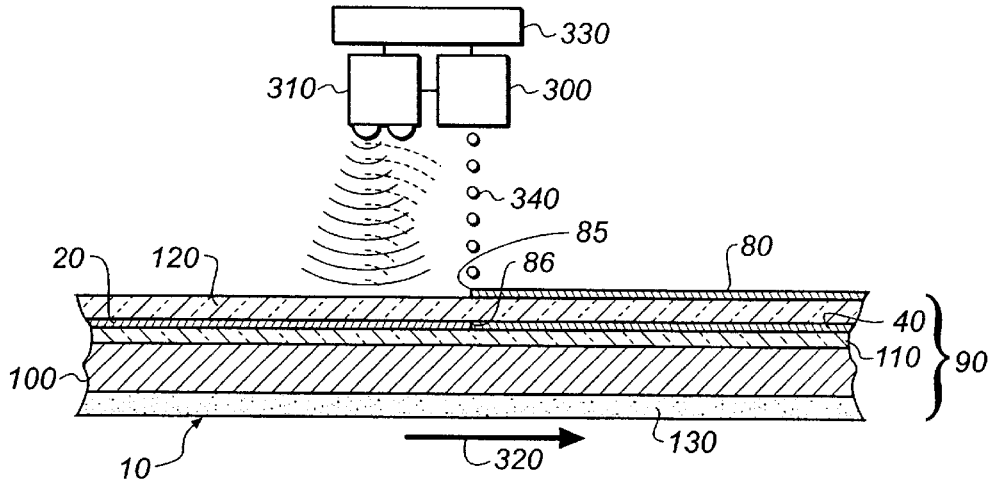
FIG. 8 is a schematic drawing illustrating the application of a protective coating via a printer onto a stamp over the personal image.

Referring to FIG. 7, there is illustrated a cross-sectional view of a stamp 10 made in accordance with the present invention, like numerals indicating like elements as previously discussed. Stamp 10 comprises two digital images that have been integrally formed in the receiving layer 110 using one of the printers described in FIG. 6. The two digital images are the official postal image 20 and personal image 40. A protective coating 80 has been applied as shown in FIG. 8 over the personal image 40. The protective coating 80 prevented the cancellation mark 60 from permanently adhering to personal image 40. In some cases the cancellation mark will not stay at all. In other cases, the cancellation mark can be easily removed, for example by wiping with a clean cloth etc. Since no protective coating was applied to the official postal area 24, the cancellation 60 mark adheres to the official postal image 20 of the stamp 10. As illustrated, the outer edge 85 of protective coating 80 is substantially in co-alignment with the outer edge 86 of personal image 40. Preferably edge 85 extends slightly past edge 86 of the personal image 40 so that the personal image 40 will not be cancelled.

In yet another embodiment of the present invention the protective coating 80 can be formed as part of the printing process of printing the personal image 40 as the personal image area 45 is being printed.

Referring to FIG. 8, there is illustrated a cross-sectional view of the stamp 10 described in FIG. 7, made in accordance with the present invention, like numerals indicating like elements as previously discussed. Using the phosphorescent characteristics of an official United States postage stamp as described in the background of the invention, a scanner 310 detects which area of the stamp 10 is the official postal image 20 and which area is the personal image 40. A protective coating 80 is applied via the print head 300 as the medium 90 on which the stamp 10 is formed moves by the scanner 310 in the direction indicated by the arrow 320. The scanner 310 is a CCD liner array filtered to detect emissions in the visible (green) region of the spectrum with a peak wavelength of 526. As the stamp 10 moves by the scanner 310 the scanner detects where the personal image 40 lies. Using the control and logic unit 330 the scanner 310 directs the print head 300 which is located in a fixed relationship to the scanner 310 to apply the protective coating 80 in the form of droplets 340. The droplets 340 spread out on impact and cover the personal image 40 with a uniform protective coating 80. The printer used for applying the coating can be for example a thermal printer, wax sublimation printer or inkjet printer. The printer does not apply the coating to the official postal area 24.

With respect to printing materials as described in U.S. Pat. No. 5,984,539 a protective coating can be applied using water-based solutions that are substantially free of volatile organic compounds. Preferred solutions can include combinations of one or more water-based latex solutions that can include at least one component, which has a glass transition temperature $T_G$, (softening point) above 25 degrees C. and at least one component which has a $T_G$(softening point) at or below 25 degrees C. These solutions can include acrylic or acylate polymers, vinyl polymers, polyurethanes, polyesters and the like. Additional components may include surfactants, spreading agents, lubricants, and anti-blocking agents, curing agents, etc.

Figure 9A:
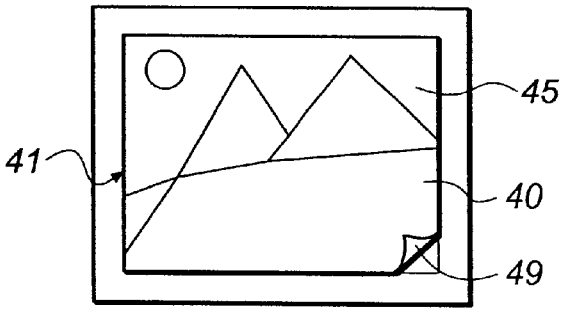
FIG. 9*a* is a schematic drawing illustrating a personal image area portion of a personalized postage stamp printed separately in the form of a sticker.
Figure 9B:
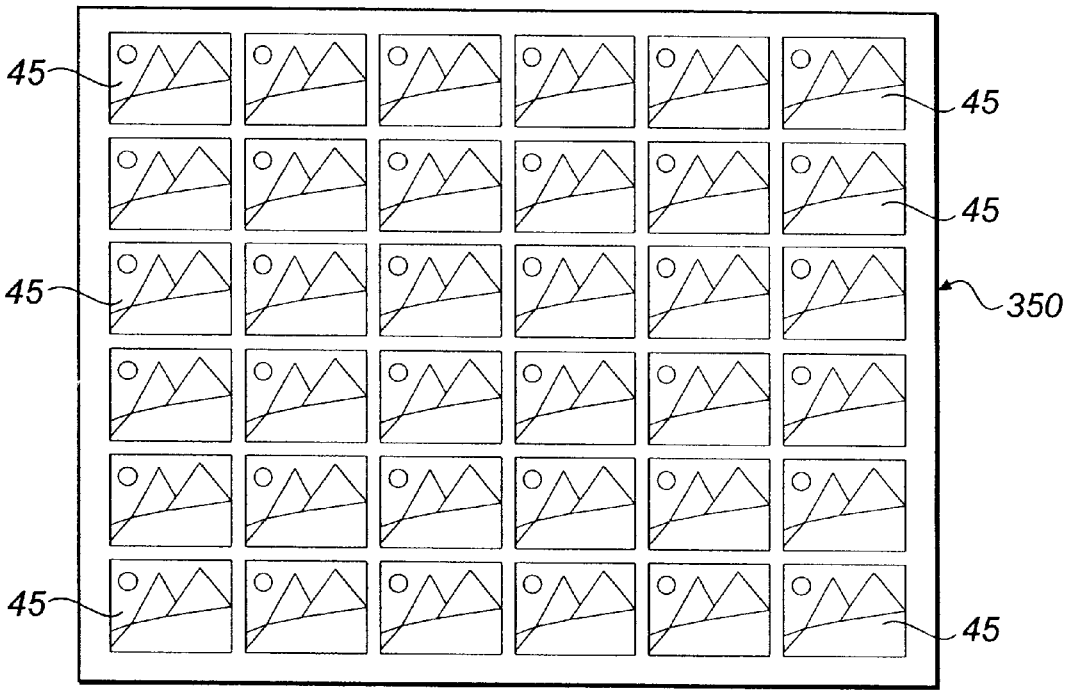
FIG. 9*b* is a schematic drawing illustrating the personalized image area of a personalized postage stamp printed separately in the form of a sheet of stickers made in accordance with the present invention.

In another embodiment as shown in FIG. 9*a*, the personal image area 45 is printed separately in the form of a sticker 41. The corner 49 of the personal image 40 is shown partially peeled off illustrating how personal image 40 may be removed at some time. The personal image area 45 can be printed in quantities on a sheet 350 using a thermal printer (not shown) such as the KODAK PS 8650 Color Printer or a KODAK Photo Printer 4700 as shown in FIG. 9*b*. Thermally printed images are used in a number of different applications. In one of those applications, so-called "sticker prints" are made on a sheet and arranged so that they can be peeled off and individually pasted onto another surface. When the personal image area 45 is printed separately, a protective layer such as is applied via the thermal printer preventing damage to the image from moisture, fingerprints, etc. The fourth pass of the thermal printing process is used to form a transferable protective layer over the image. The transferable protection layer comprises poly (vinylformal), poly (vinyl benzyl) or poly (vinyl acetyl) containing at least about 5 mole % hydroxyl. For a more complete description of this process reference is made to commonly assigned U.S. Pat. Nos. 5,387,573 and 5,332,713 which are incorporated herein by reference. As such the protective layer applied in this manner will prevent the cancellation mark from adhering to the personal image area 45.

Figure 9C:
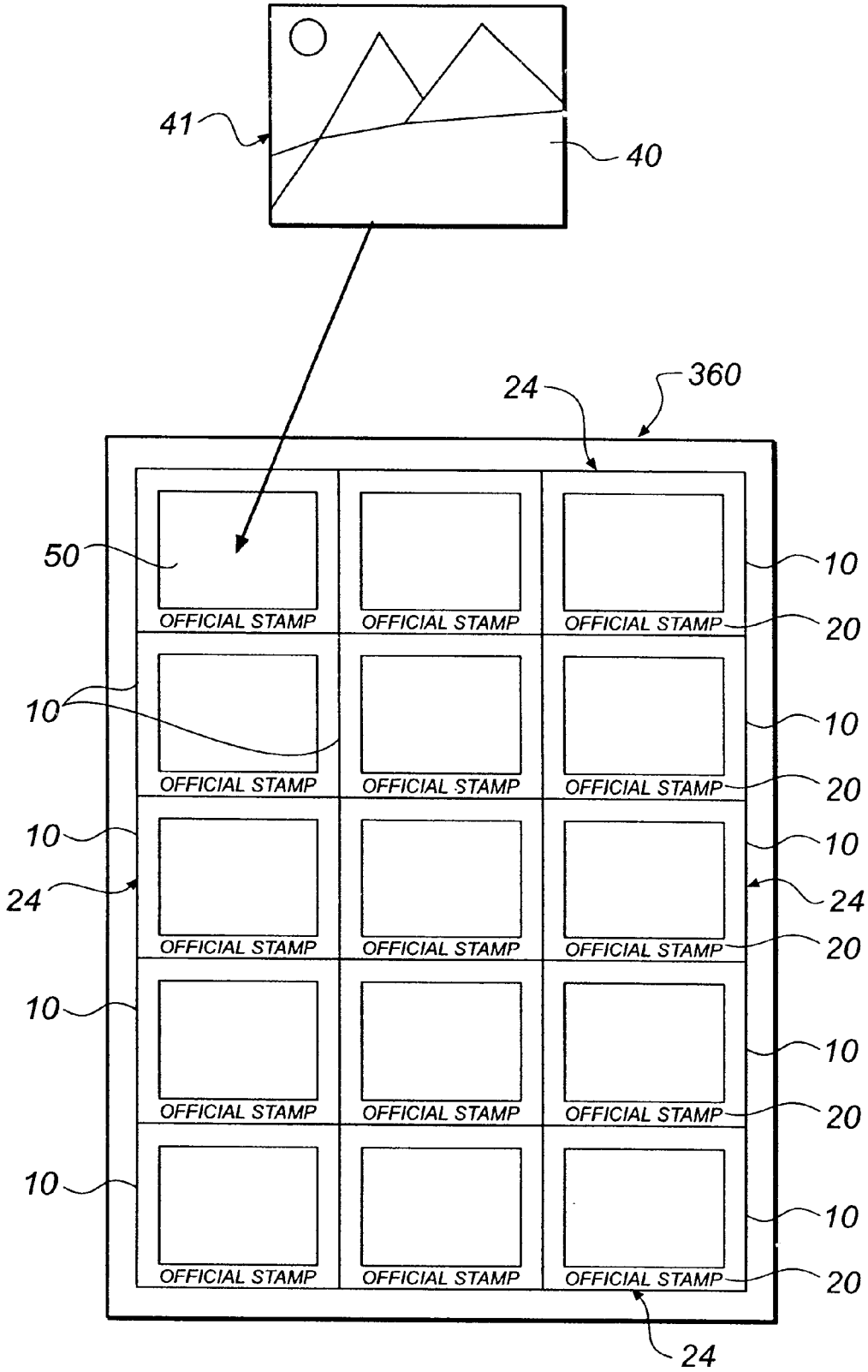
FIG. 9*c* is a schematic drawing illustrating the official portion of a plurality of personalized postage stamps printed in the form of a sheet made in accordance with the present invention.

Referring now to FIG. 9*c*, a schematic drawing of personalized postage stamps 10 having the official postal stamp area 24 and the area 50 designated for the personal image printed separately in the form of sheet 360. The sticker 41 containing the personal image 40 is peeled from the sheet 350 and adhered directly to the official stamp in a designated area 50.

Figure 9E:
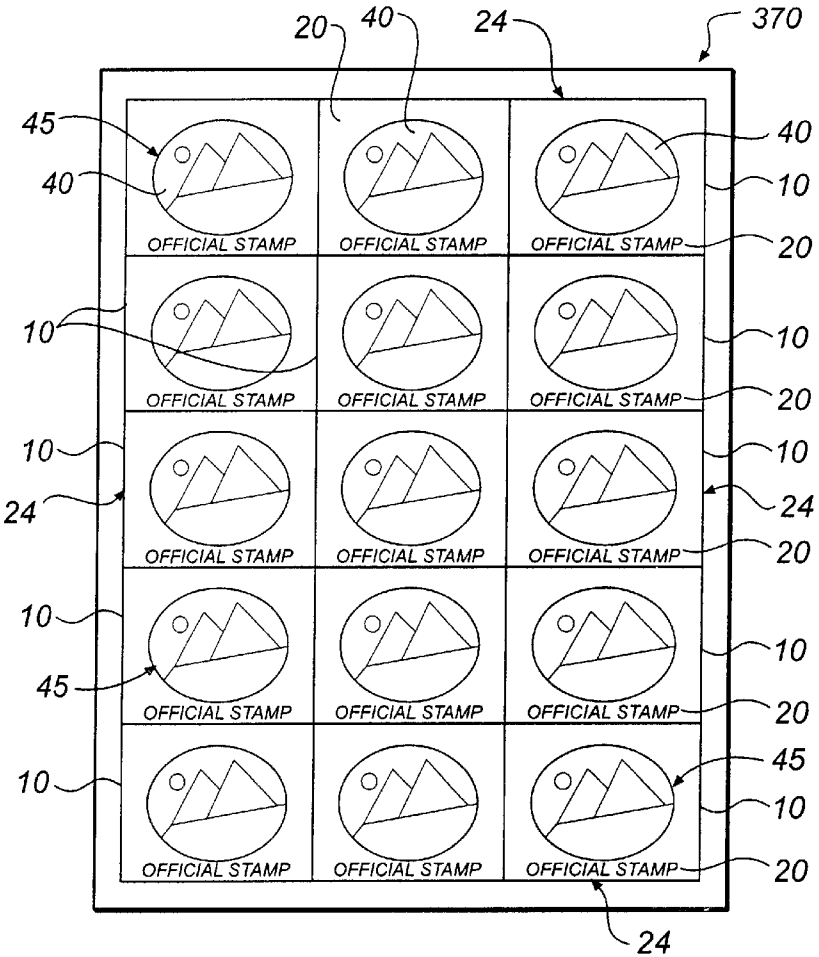
FIG. 9*e* is a schematic drawing illustrating a sheet of a plurality of personalized postage stamps after the personal image has been printed in the personal image area made in accordance with the present invention.
Figure 9D:
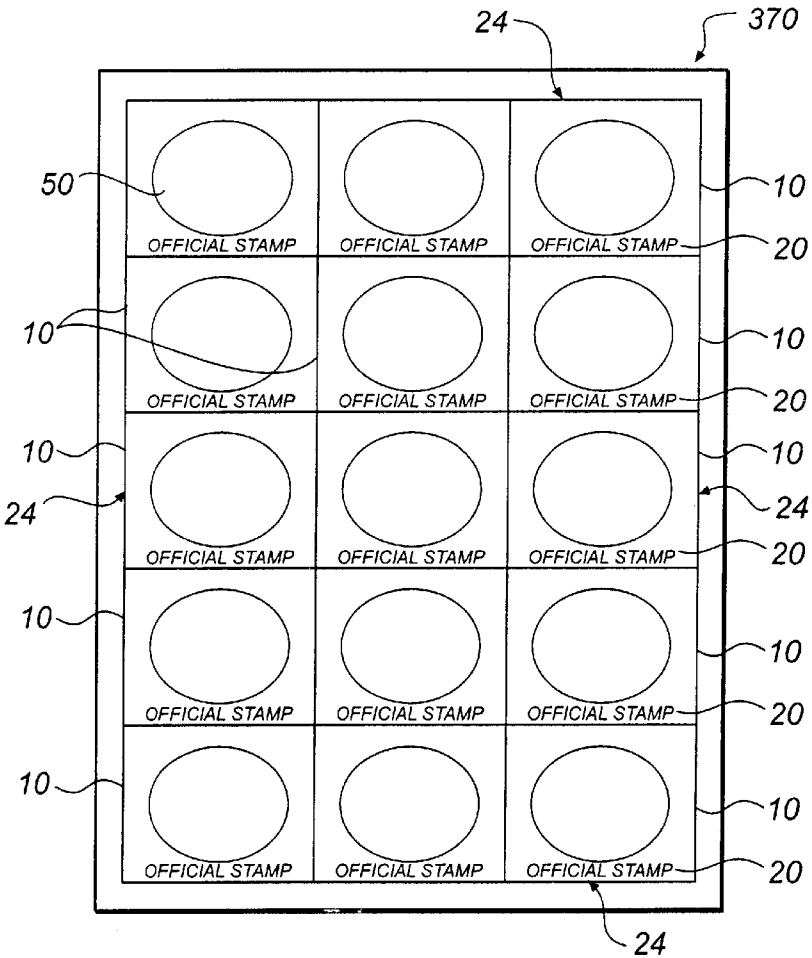
FIG. 9*d* is a schematic drawing illustrating the official portion of a plurality of personalized postage stamps printed in the form of a sheet made in accordance with the present invention.

Referring now to FIG. 9*d*, a schematic drawing of personalized postage stamps 10 having the official postal stamp area 24 and the area 50 designated for the personal image 40 (See FIG. 9*d*) printed separately in the form of sheet 370. Sheet 370 may be printed using any acceptable printing technique.

Referring now to FIG. 9*e*, there is illustrated a schematic drawing of sheet 370 of FIG. 9*d* having the personal image 40 printed in the personal image area 45 as discussed previously like numbers designate like elements. In one form, the image 40 is printed using one technique (such as inkjet) where only the personal image 40 is printed with an ink that will not accept a cancellation mark. Alternatively as discussed later, another printing technique can be used for image 40 where the cancellation mark is not provided on the image 40.

Figure 10:
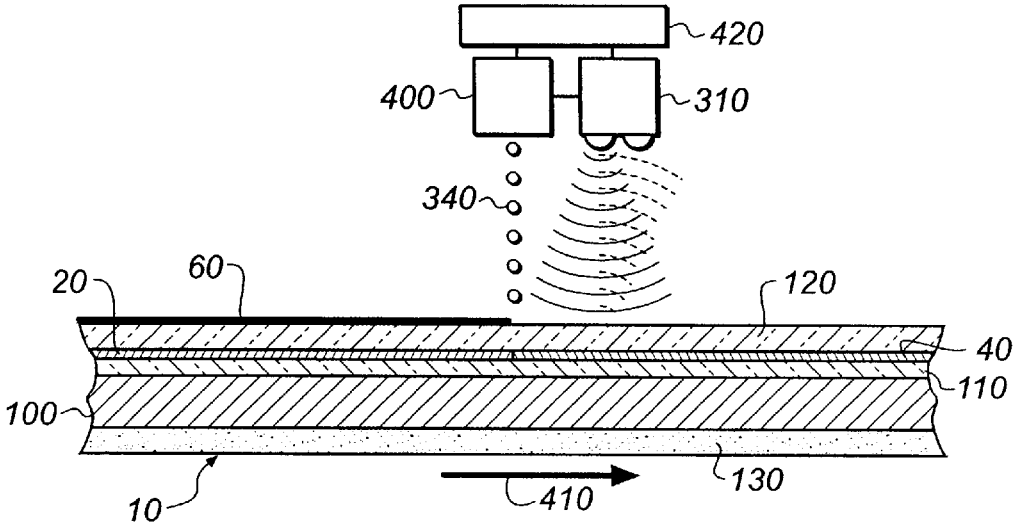
FIG. 10 is a schematic drawing illustrating the application of the cancellation mark via a printer onto stamp over the official postal image.

In yet another embodiment referring to FIG. 10, there is illustrated a cross-sectional view of the stamp 10, described in FIG. 7 and system for canceling the official postal area 24, made in accordance with the present invention, like numerals indicating like elements as previously discussed. During the sorting and cancellation process the CCD liner array scanner 310 (described in FIG. 8) using the phosphorescent characteristics of an official United States postage stamp as described in the background of the invention, detects the official postage image area 20 and which area is the personal image 40. As the envelope 70 carrying the stamp 10 moves by the scanner 310 in the direction indicated by the arrow 410 the scanner detects where the official postage image area 20 is located. The scanner 310 directs an inkjet print head 400 via a logic and control unit 420 to apply the cancellation mark 60 only across the official postage image area 20 of the stamp 10. Using this method no cancellation mark is applied over the personal image 40.

The invention has been described in detail with particular reference to certain preferred embodiments thereof, but it will be understood that variations and modifications can be effected within the scope of the invention, the present invention being defined by the following claims.

PARTS LIST

10 Stamp
20 Official postal image
24 Official postal image area
25 Line
26 Line
27 Line
28 Line
30 Perforations
40 Personal image
41 Sticker
45 Personal image area
49 Corner
50 Designated area
60 Cancellation mark
70 Postal Product
80 Protective coating
85 Outer edge
86 Edge
90 Medium
100 Support layer
105 Top surface
106 Bottom surface
110 Receiving layer
120 Protective layer
200 Image

210 Inkjet print head
220 Ink
300 Print head
310 Scanner
320 Arrow
13 Logic and control logic unit
340 Droplet
350 Sheet
360 Sheet
370 Sheet Inkjet print head arrow
400 Logic and control logic unit
410 Arrow
420 Control Unit

What is claimed is:

1. An apparatus for applying a protective coating on a personalized image product, said personalized image product comprising a first area having an official postage image thereon and a second area having a personal image thereon, comprising:

a scanner capable of determining the location of said second area; and a coating device for applying a protective coating only to said second area as determined by said scanner in response to said scanner determining said location of said second area, said protective coating for repelling a postal cancellation mark.

2. An apparatus according to claim 1 wherein coating device comprises a thermal printer.

3. An apparatus according to claim 1 wherein said coating device is a wax sublimation printer.

4. An apparatus for providing a cancellation on an official postal product, said official postal product having an official image area having a a first area having an official postal indicia and a second area having a personal image, comprising:

a scanner for determining the location of said first area; and a printhead for applying a cancellation onto said first area as determined by said scanner in response to scanner locating said first area.

5. An apparatus according to claim 3 wherein said print head comprises an ink jet printhead.

* * * * *